US006746596B2

(12) United States Patent
Chung et al.

(10) Patent No.: US 6,746,596 B2
(45) Date of Patent: Jun. 8, 2004

(54) PROCESS FOR REDUCING SULPHUR EMISSIONS FROM A FLUIDIZED BED COKE BURNER

(75) Inventors: Keng H. Chung, Edmonton (CA); Edward Furimsky, Ottawa (CA)

(73) Assignees: AEC Oil Sands, L.P., Calgary (CA); AEC Oil Sands Limited Partnership, Calgary (CA); Athabasca Oil Sands Investment Inc., Calgary (CA); Nexen Inc., Calgary (CA); Canadian Oil Sands Investments Inc., Calgary (CA); Gulf Canada Resources Limited, Calgary (CA); Imperial Oil Resources, Calgary (CA); Mocal Energy Limited, Tokyo (JP); Murphy Oil Company Ltd., Calgary (CA); Petro-Canada, Calgary (CA)

( * ) Notice: Subject to any disclaimer, the term of this patent is extended or adjusted under 35 U.S.C. 154(b) by 174 days.

(21) Appl. No.: 09/879,885

(22) Filed: Jun. 14, 2001

(65) Prior Publication Data

US 2003/0000868 A1 Jan. 2, 2003

(51) Int. Cl.[7] ..... C10G 9/28; C10G 9/32

(52) U.S. Cl. ..... 208/127; 208/53; 208/126; 208/131

(58) Field of Search ..... 208/53, 126, 127, 208/131

(56) References Cited

U.S. PATENT DOCUMENTS

| | | | | | |
|---|---|---|---|---|---|
| 2,881,130 | A | * | 4/1959 | Pfeiffer et al. | 208/127 |
| 3,617,513 | A | * | 11/1971 | Wilson, Jr. | 208/127 |
| 3,803,023 | A | * | 4/1974 | Hamner | 208/127 |
| 4,528,088 | A | * | 7/1985 | Chang et al. | 208/96 |
| 4,587,010 | A | * | 5/1986 | Blaser et al. | 208/127 |
| 4,882,036 | A | * | 11/1989 | Eidt, Jr. et al. | 208/50 |
| 4,954,240 | A | * | 9/1990 | Eidt, Jr. et al. | 208/50 |

* cited by examiner

*Primary Examiner*—Walter D. Griffin
(74) *Attorney, Agent, or Firm*—Millen, White, Zelano & Branigan, P.C.

(57) ABSTRACT

The process has to do with a circuit involving a fluidized bed coker reactor working in tandem with a fluidized bed coke burner. The burner is operated at a reduced temperature in the range 550° C.–630° C. Simultaneously, the coke circulation rate is increased to ensure the heat requirement of the reactor is met. It is found that sulphur emissions from the burner are significantly reduced.

8 Claims, 2 Drawing Sheets

PROCESS FOR REDUCING SULPHUR EMISSIONS FROM A FLUIDIZED BED COKE BURNER

FIELD OF THE INVENTION

The present invention relates to heavy oil fluid coking involving the circulation of coke through a fluidized bed coke burner for developing heat to be used in a fluidized bed coker. The invention has to do with reducing sulphur gaseous emissions from the burner.

BACKGROUND OF THE INVENTION

Fluid coking is a commercially practiced process applied to heavy oil, such as bitumen, to produce lighter fractions.

The process is illustrated in FIG. 1. It involves a fluidized bed coker reactor working in tandem with a fluidized bed coke burner. In the reactor, incoming feed oil contacts a fluidized bed of hot coke particles and heat is transferred from the coke particles to the oil. The reactor is conventionally operated at a temperature of about 530° C. Hot coke entering the reactor is conventionally at a temperature of 645° C. to supply the heat requirement of the coker. "Cold" coke is continuously removed from the reactor and returned to the burner. The cold coke leaving the reactor is at a temperature of about 530° C. In the burner, the cold coke is partially combusted with air, to produce hot coke. Part of the hot coke is recycled to the reactor to provide the heat required. The balance of the hot coke is removed from the burner as product coke. The burner is conventionally operated at a temperature of 645° C. The burner temperature is controlled by controlling the addition of air.

As mentioned, the combustion of coke in the burner is only partial in nature. On entering the burner, part of the coke particle is burned and releases volatiles. These volatiles support the combustion that provides the heat required by the reactor. The burner produces product gas which comprises fuel gas, $H_2S$, $SO_2$, COS and coke fines. This product gas is burned in a boiler. A flue gas leaves the boiler and is emitted to atmosphere through a stack. The flue gas contains $SO_2$.

It is the purpose of the present invention to reduce the sulphur compound content in the burner product gas and thus in the stack flue gas.

SUMMARY OF THE INVENTION

The present invention is based on the results of an experimental program conducted to determine the effect of coke burner operating conditions on product gas composition, specifically with respect to sulphur gas production.

The following discoveries were made in the course of this program:

- It was found that the volatiles, represented by $CH_4$, were produced by coke undergoing combustion at a lower temperature than the sulphur compounds, represented by $H_2S$. More particularly, the release of $CH_4$ commenced at a temperature of about 380 °C. and reached a maximum rate at about 570° C., whereas the release of $H_2S$ commenced at about 500° C. and reached a maximum rate at about 650° C.;
- It was further found that the profile for $H_2S$ evolution at increasing temperatures took the form of a parabolic curve having steeply rising and descending legs; and
- It was further found that there was very little diminution in the size of the coke particles in the course of pyrolysis in the burner.

From these observations we concluded:

- That volatile gases are produced from a thin outer skin portion of the coke particle and it is these gases that combust in the burner and produce most of the required heat;
- That since these volatile gases are produced at a significantly lower temperature than the sulphur-containing gases, one could reduce burner temperature and thereby reduce sulphur gas emissions, without significantly affecting the capacity of the burner to supply the heat needs of the coker;
- But one would need to increase the coke circulation rate, as the temperature of the hot coke leaving the burner would now be less, in order to prevent bogging and meet the heat need of the coker As a result of acquiring these understandings, a process was outlined involving:

- maintaining the burner temperature in the range of about 550° C.–630° C.; and
- maintaining the coke circulation rate sufficient to meet the heat requirements of the coker, for example in the range 75 tons/min to 115 tons/min, particularly preferably about 90 tons/min, at an oil throughput of 110 kB/d to the coker.

The process was tested in a plant circuit consisting of two identical cokers. The burner temperature and coke circulation rate were changed from the conventional operating conditions as follows:

| | Prior Conditions | New Conditions |
|---|---|---|
| burner temperature | 645° C. | 624° C. |
| coke circulation rate | 80 tons/min | 92 tons/min |
| oil throughput per coker | 110 kB/d | 110 kB/d |

The $SO_2$ discharge at the stack was reduced from 230 tonnes/day to 180 tonnes/day.

DESCRIPTION OF THE PREFERRED EMBODIMENT

The invention is based on the following experimental results.

Evolution of Gases from Coke

Figure 2:
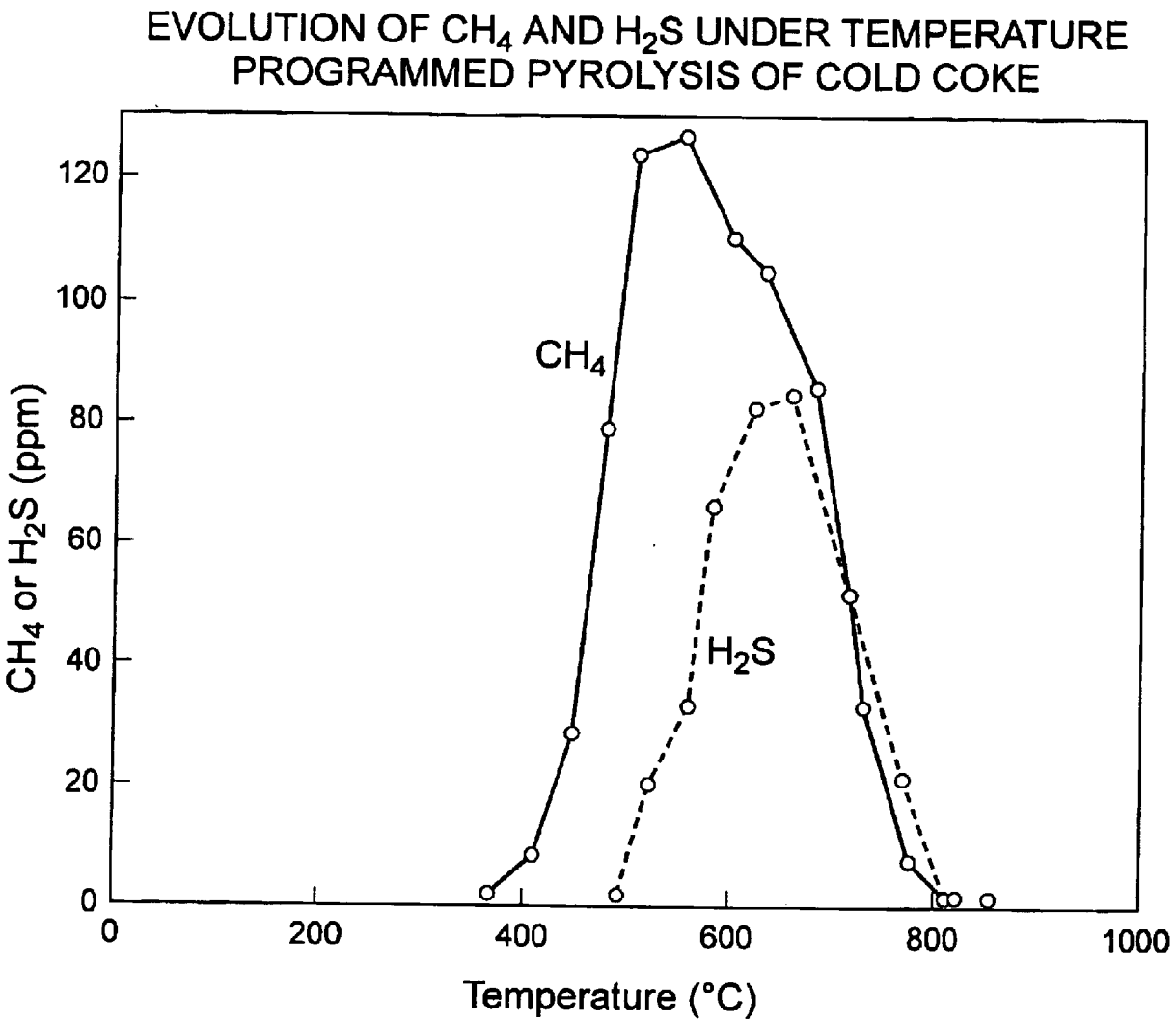
FIG. 2 is a plot showing the evolution of $CH_4$ and $H_2S$ during pyrolysis of coke at different temperatures.

Experiments were carried out in which one gram of coke particles was loaded into quartz tubing and heated in a temperature-programmed furnace. Inert purge gas was used to sweep the volatile matter from the coke. Gas chromatography was used to analyze the effluent. FIG. 2 compares the evolution of $CH_4$ and $H_2S$ under temperature programmed (20° C./min) pyrolysis of cold coke. As shown, the $CH_4$ began to evolve at a lower temperature (~400° C.) than the $H_2S$ (~500° C.).

Plant Test

Figure 1:
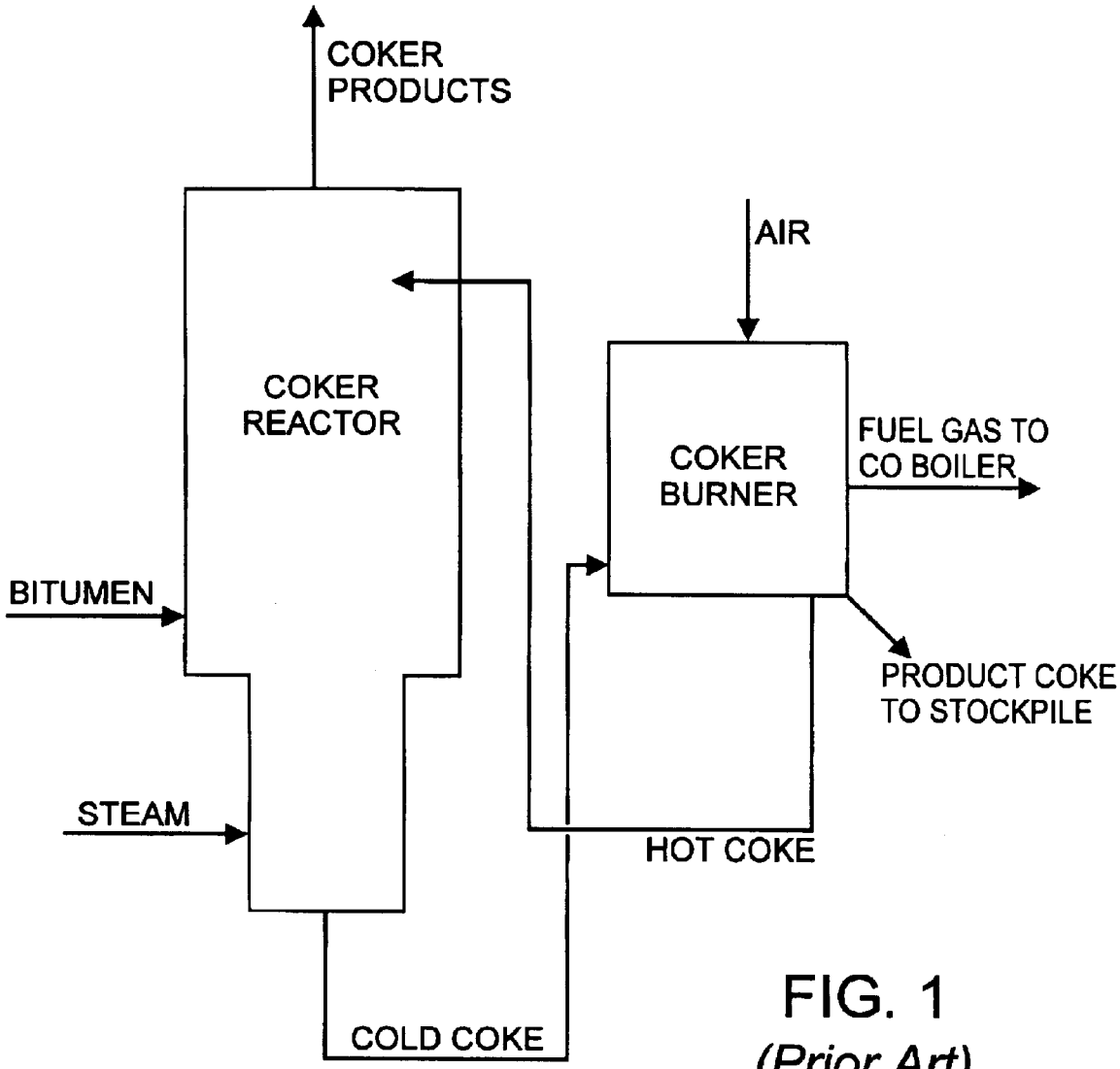
FIG. 1 (Prior Art)
FIG. 1 is a simplified schematic of a known fluid coking circuit.

The process of this application was tested in a commercial plant consisting of two identical fluidized bed coker/burner circuits as shown in FIG. 1. The conventional burner temperature was reduced and the coke circulation rate was increased. More particularly, the oil feedrate to each coker was maintained at 110 kB/d. The burner temperature was reduced from the conventional 645–650° C. and maintained at 628–633° C. (that is, at about 630° C.). The coke circulation rate was increased from the conventional rate of 80 tons/min and maintained at 92 tons/min. The sulphur emission was monitored at the stack and was reduced from 230 tonnes/day to 180 tonnes/day.

The embodiments of the invention in which an exclusive property or privilege is claimed are defined as follows:

1. In a method for fluid coking of a heavy oil containing sulfur compounds which comprised fluid coking the heavy oil in a fluidized bed coke reactor working in tandem with a fluidized bed coke burner, wherein cold coke was circulated from the reactor to the burner and partly burned in the burner at a temperature of about 645° C. with emission of gaseous sulfur compounds, and the resulting hot coke was circulated from the burner to the reactor at a circulation rate sufficient to provide the heat for fluid coking of the heavy oil, the improvement comprising:

partly burning the cold coke in the burner at a temperature from 550° C. to 630° C., such that the emission of gaseous sulfur compounds is significantly reduced compared to when the temperature is about 645° C., and to compensate for the lower temperature of the hot coke, increasing the hot coke circulation rate from the burner to the reactor to provide the heat for fluid coking of the heavy oil.

2. The method of claim 1, wherein the increased hot coke circulation rate is about 75–115 tons/minute.

3. The method of claim 1, wherein the burner temperature is about 630° C.

4. The method of claim 1, wherein the increased hot coke circulation rate is about 90 tons/minute.

5. The method of claim 1, wherein the heavy oil is bitumen.

6. The method of claim 5, wherein the method results in an $SO_2$ discharge of about 180 tons per 110 kB of heavy oil throughput.

7. The method of claim 1, wherein the burner temperature is from 550 to 600° C.

8. The method of claim 1, wherein the reactor is operated at a temperature of about 530° C.

* * * * *